US006880355B2

(12) United States Patent
Jung

(10) Patent No.: US 6,880,355 B2
(45) Date of Patent: Apr. 19, 2005

(54) REFRIGERATOR WITH ICE FEEDING UNIT

(75) Inventor: Sang Gyu Jung, Kwangju (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 10/727,686

(22) Filed: Dec. 5, 2003

(65) Prior Publication Data

US 2004/0163405 A1 Aug. 26, 2004

(30) Foreign Application Priority Data

Jan. 21, 2003 (KR) ..... 10-2003-0004130

(51) Int. Cl.[7] ..... F25C 5/18
(52) U.S. Cl. ..... 62/320; 62/344; 251/129.11
(58) Field of Search ..... 62/320, 344; 251/129.11, 251/251; 74/424; 222/146.6

(56) References Cited

U.S. PATENT DOCUMENTS 4,250,923 A * 2/1981 Johnson ..... 137/625.69
4,280,682 A * 7/1981 Zukausky et al. ..... 251/251
4,922,725 A * 5/1990 Rasmussen ..... 62/136
5,273,219 A 12/1993 Beach, Jr. et al.
5,310,090 A * 5/1994 Taylor, Jr. ..... 222/129
5,327,856 A * 7/1994 Schroeder et al. ..... 123/90.11
6,053,472 A * 4/2000 DeLand ..... 251/129.11
6,062,826 A * 5/2000 Morimoto et al. ..... 417/297
6,708,726 B1 * 3/2004 Hashimoto ..... 137/870
6,755,166 B1 * 6/2004 Chang et al. ..... 123/90.26

FOREIGN PATENT DOCUMENTS

KR 2000-27087 5/2000

* cited by examiner

*Primary Examiner*—William E. Tapolcai
(74) *Attorney, Agent, or Firm*—Staas & Halsey LLP

(57) ABSTRACT

A refrigerator with an ice feeding unit allows an outlet control unit which opens or closes an outlet of an ice container, to be quietly operated. The refrigerator with the ice feeding unit includes an ice container in an ice storage compartment. A control member is installed at a position around an outlet of the ice container to open or close the outlet of the ice container. A connection rod is rotatably installed at a predetermined position of the ice container to operate the control member. A first eccentric part is provided at a first end of the connection rod which is in contact with the control member, to be eccentric from a center of rotation of the connection rod, and a second eccentric part is provided at a second end of the connection rod which is opposite to the first end of the connection rod, to be eccentric from the center of rotation of the connection rod. A rotary cam is installed to be in contact with the second eccentric part of the connection rod, and functions to rotate the second eccentric part of the connection rod at a predetermined angle. A motor drives the rotary cam.

10 Claims, 5 Drawing Sheets

REFRIGERATOR WITH ICE FEEDING UNIT

CROSS-REFERENCE TO RELATED APPLICATIONS

This application claims the benefit of Korean Patent Application No. 2003-4130, filed on Jan. 21, 2003 in the Korean Intellectual Property Office, the disclosure of which is incorporated herein by reference.

BACKGROUND OF THE INVENTION

1. Field of the Invention

The present invention relates, in general, to a refrigerator with an ice feeding unit and, more particularly, to a refrigerator with an ice feeding unit which reduces operating noise of the ice feeding unit.

2. Description of the Related Art

A large-capacity conventional refrigerator includes an ice making unit to make ice cubes, and an ice container to hold the ice cubes made in the ice making unit. The refrigerator has, at a door thereof, an ice discharging path and an ice dispensing unit to allow a user to take the ice cubes from the ice container without opening the door. Further, an ice feeding unit is provided at a predetermined position in a cooling compartment of the refrigerator so as to feed the ice cubes from the ice container to the ice discharging path.

As shown in FIG. 1, the ice feeding unit of the conventional refrigerator includes a coiled feeding shaft 2 which is installed in an ice container 1 to feed ice cubes, a guide cylinder 3 which guides the ice cubes, a spiral blade 4 which is provided in the guide cylinder 3 to push the ice cubes, and an ice crusher 5 which crushes the ice cubes guided by the spiral blade 4.

The ice feeding unit also has a drive motor 6 to rotate the feeding shaft 2, and an outlet control unit to open or close an outlet 1*a* of the ice container 1 which is adjacent to the ice crusher 5. The outlet control unit includes a control member 7, a connection rod 8, and a solenoid drive unit 9. The control member 7 is rotatably installed at a position around the outlet 1*a* of the ice container 1. The connection rod 8 is rotatably mounted at a predetermined position of the ice container 1 to operate the control member 7, and extends from a position around the outlet 1*a* to a position opposite to the outlet 1*a* in a horizontal direction. The solenoid drive unit 9 is provided at a rear portion of the ice container 1 to be adjacent to the drive motor 6, and functions to rotate the connection rod 8 at a predetermined range, thus operating the control member 7. As shown in FIG. 2, when a movable part 9*a* of the solenoid drive unit 9 reciprocates within a predetermined range, a first eccentric part 8*a* provided at a rear end of the connection rod 8 rotates in a predetermined range to rotate the connection rod 8. At this time, a second eccentric part 8*b* which is opposite to the first eccentric part 8*a*, operates the control member 7, thus opening or closing the outlet 1*a* of the ice container 1.

However, the conventional ice feeding unit has a problem that there may occur a clicking sound whenever the solenoid drive unit 9 is operated to actuate the control member 7, since the control member 7 is operated by the solenoid drive unit 9 which reciprocates by electricity. Thus, there may be noise due to interference between the movable part 9*a* of the solenoid drive unit 9 and the connection rod 8 when the movable part 9*a* of the solenoid drive unit 9 is operated.

SUMMARY OF THE INVENTION

Accordingly, it is an aspect of the present invention to provide a refrigerator with an ice feeding unit which allows an outlet control unit to open or close an outlet of an ice container without generating noise.

Additional aspects and/or advantages of the invention will be set forth in part in the description which follows and, in part, will be obvious from the description, or may be learned by practice of the invention.

These and/or other aspects are achieved by providing a refrigerator comprising an ice feeding unit comprising an ice container, a control member, a connection rod, a rotary cam, and a motor. The ice container is provided in an ice storage compartment. The control member is installed at a position around an outlet of the ice container to open or close the outlet of the ice container. The connection rod is rotatably installed at a predetermined position of the ice container to operate the control member. A first eccentric part is provided at a first end of the connection rod which is in contact with the control member, to be eccentric from a center of rotation of the connection rod, and a second eccentric part is provided at a second end of the connection rod which is opposite to the first end of the connection rod, to be eccentric from the center of rotation of the connection rod. The rotary cam is installed to be in contact with the second eccentric part of the connection rod, and rotates the second eccentric part of the connection rod at a predetermined angle. The motor drives the rotary cam.

The connection rod horizontally extends from a position around the outlet of the ice container to a position opposite to the outlet of the ice container. The connection rod is bent at the first and second ends thereof to form the first and second eccentric parts.

The rotary cam is a cylindrical shape having an inclined cam face formed at an end of the rotary cam to be in contact with the second eccentric part of the connection rod.

BRIEF DESCRIPTION OF THE DRAWINGS

These and/or other aspects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
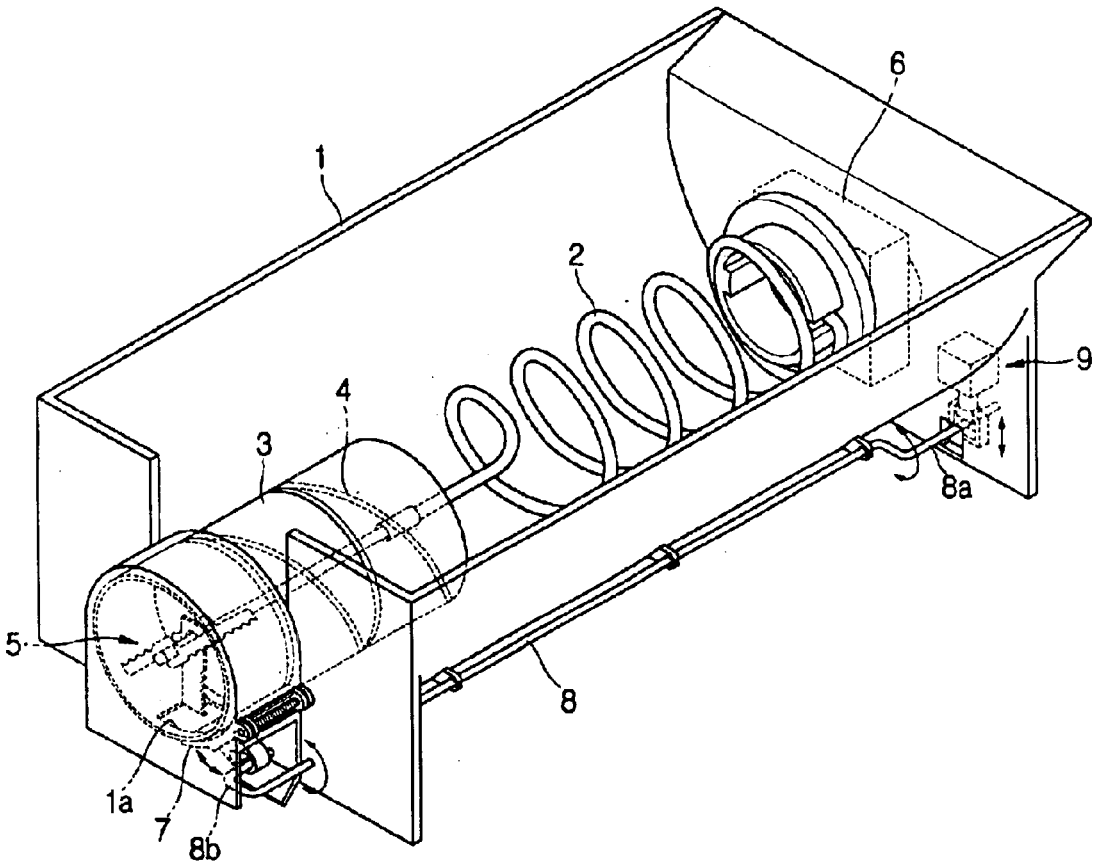
FIG. 1 (PRIOR ART)
FIG. 1 is a perspective view of a conventional ice feeding unit for a refrigerator.
Figure 2:
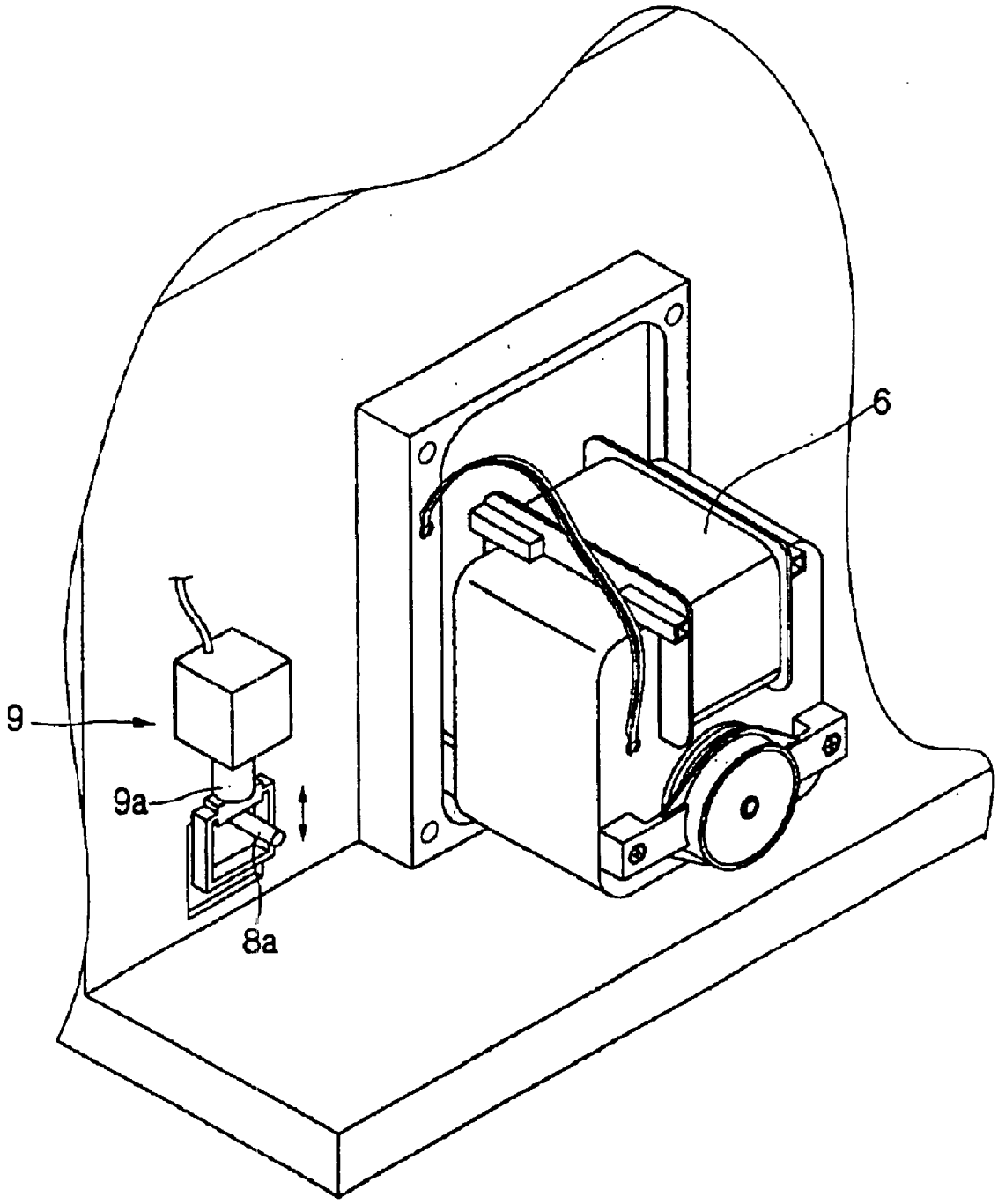
FIG. 2 (PRIOR ART)
FIG. 2 is a perspective view of a solenoid drive unit included in the ice feeding unit of FIG. 1.

Reference will now be made in detail to the embodiments of the present invention, examples of which are illustrated in the accompanying drawings, wherein like reference numerals refer to like elements throughout. The embodiments are described below to explain the present invention by referring to the figures.

Figure 3:
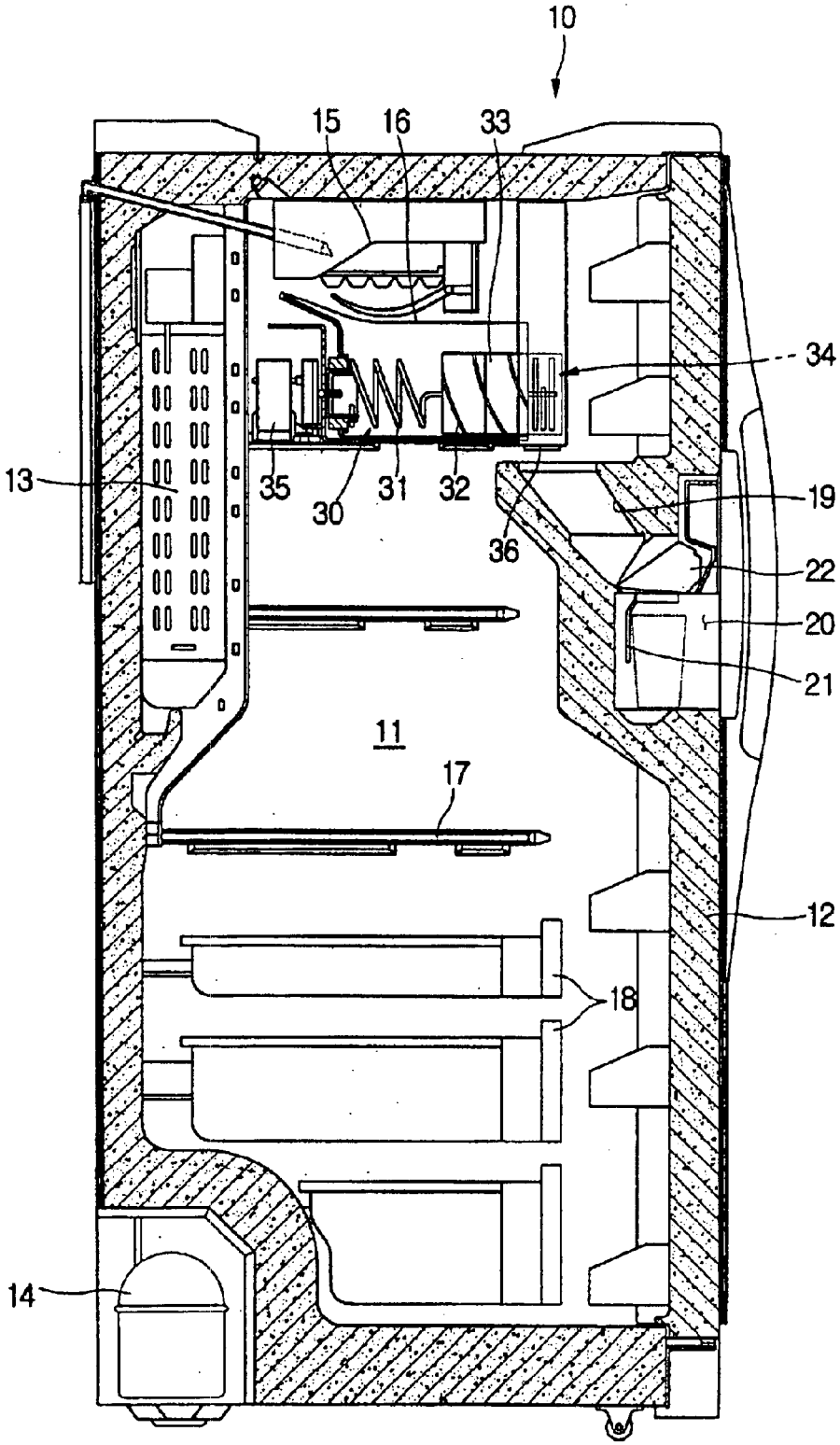
FIG. 3 is a sectional view showing an interior of a refrigerator with an ice feeding unit, according to an embodiment of the present invention.

As shown in FIG. 3, a refrigerator according to an embodiment of the present invention includes a cabinet 10. A cooling compartment 11 is vertically defined in the cabinet 10, and is opened at a front thereof. A door 12 is mounted to the front of the cooling compartment 11 to open or close the front of the cooling compartment 11. An evaporator 13 is mounted to a rear portion of the cabinet 10 to generate cool air. A compressor 14 is mounted to a lower portion of the cabinet 10.

An automatic ice making unit 15 is mounted to an upper portion of the cooling compartment 11 to make ice cubes. An ice container 16 is provided under the automatic ice making unit 15 to contain the made ice cubes therein. Further, a plurality of shelves 17 and drawers 18 are installed in the cooling compartment 11 to store frozen food.

Further, an ice discharging path 19 is provided at a predetermined position of the door 12 to communicate with an interior of the cooling compartment 11, thus allowing a user to take the ice cubes from the ice container 16 without opening the door 12. An ice dispensing recess 20 is provided on a front surface of the door 12 so as to easily receive the ice cubes discharged through the ice discharging path 19. In the ice dispensing recess 20 are provided a switch 21 to open or close an outlet of the ice discharging path 19 and operate the ice feeding unit 30 installed in the cooling compartment 11, and a guide member 22 to prevent dispersion of the ice cubes discharged from the ice discharging path 19.

Figure 4:
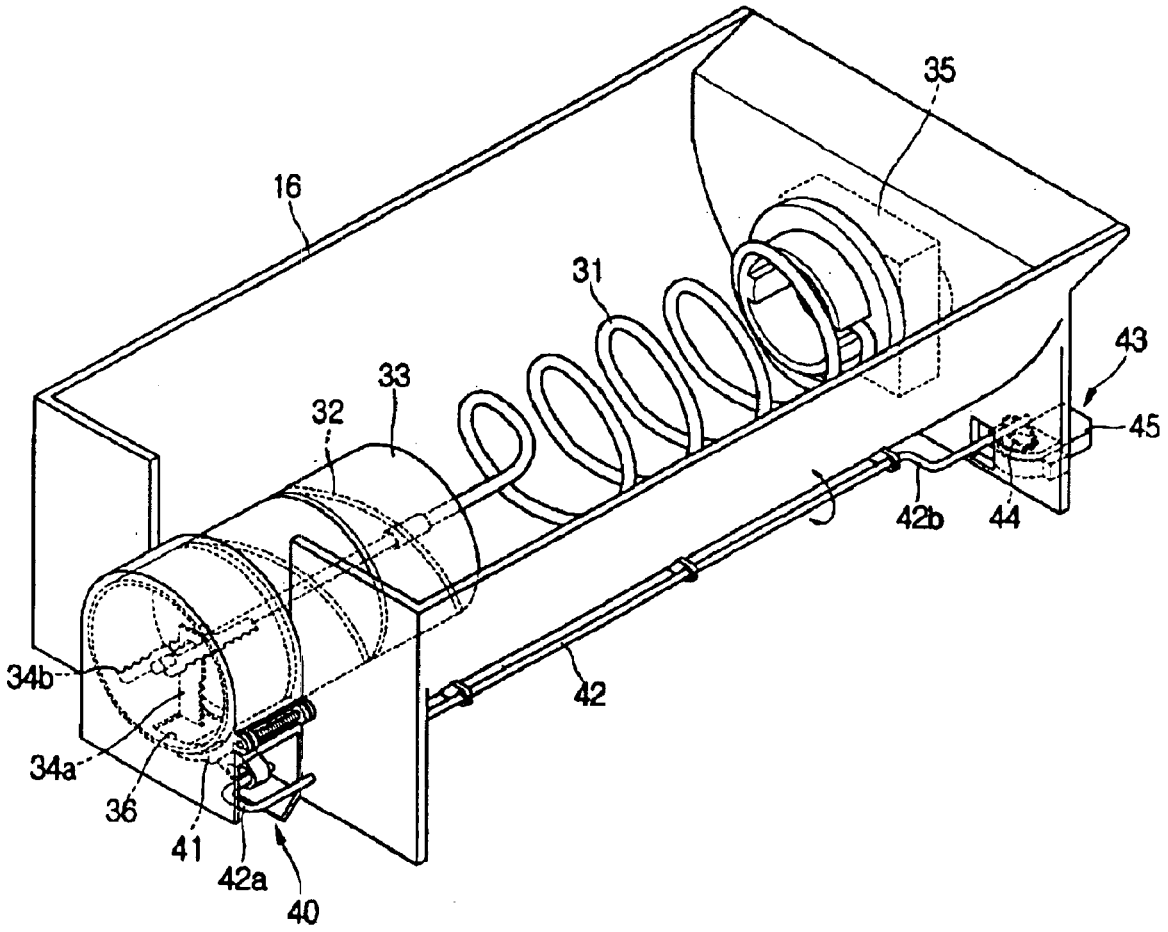
FIG. 4 is a perspective view of the ice feeding unit included in the refrigerator of FIG. 3.

As shown in FIG. 4, the ice feeding unit 30 functions to feed the ice cubes from the ice container 16 to the ice discharging path 19. The ice feeding unit 30 includes a coiled feeding shaft 31 and a spiral blade 32. The feeding shaft 31 is rotatably installed in the ice container 16. An ice crusher 34 is installed at a position around an outlet 36 of the ice container 16 to finely crush the ice cubes. A drive motor 35 is mounted to a rear portion of the ice container 16 to rotate the feeding shaft 31, the spiral blade 32, and the ice crusher 34.

The feeding shaft 31, the spiral blade 32, and the ice crusher 34 are coaxially arranged in a row. When the drive motor 35 is operated, the feeding shaft 31 is rotated along with the spiral blade 32 and the ice crusher 34. The ice feeding unit 30 includes a guide cylinder 33. The guide cylinder 33 surrounds an outer circumference of the spiral blade 32 to push the ice cubes to the outlet 36 of the ice container 16. The ice crusher 34 includes a fixed cutter 34*a* which is fixed at a position around the outlet 36, and a rotatable cutter 34*b* which is rotated along with the feeding shaft 31. Thus, when the rotatable cutter 34*b* is rotated, the ice cubes are held between the fixed and rotatable cutters 34*a* and 34*b* to be cut.

Referring to FIG. 4, the refrigerator according to the present invention comprises an outlet control unit 40 to open or close the outlet 36 of the ice container 16. According to an opening ratio of the outlet 36 which is controlled by the outlet control unit 40, ice cubes of large sizes or ice pieces of small sizes may be dispensed through the outlet 36. The outlet control unit 40 comprises a control member 41, a connection rod 42, and a cam drive unit 43. The control member 41 is rotatably mounted to a position around the outlet 36 of the ice container 16. The connection rod 42 is rotatably mounted along a side of the ice container 16 to operate the control member 41. The cam drive unit 43 is installed at a predetermined position of the rear portion of the ice container 16 so as to rotate the connection rod 42 in a predetermined rangeand to operate the control member 41.

The connection rod 42 is rotatably mounted to an outer surface of the ice container 16, and horizontally extends from a position around the outlet 36 of the ice container 16 to a position opposite to the outlet 36 of the ice container 16. The connection rod 36 is bent at opposite ends thereof to form first and second eccentric parts 42*a* and 42*b* which are eccentric from a center of rotation of the connection rod 36. This construction allows the cam drive unit 43 to rotate the second eccentric part 42*b*, thus resulting in a rotation of the connection rod 42. When the connection rod 42 is rotated, the first eccentric part 42*a* is rotated to rotate the control member 41, thus opening or closing the outlet 36 of the ice container 16.

Figure 5:
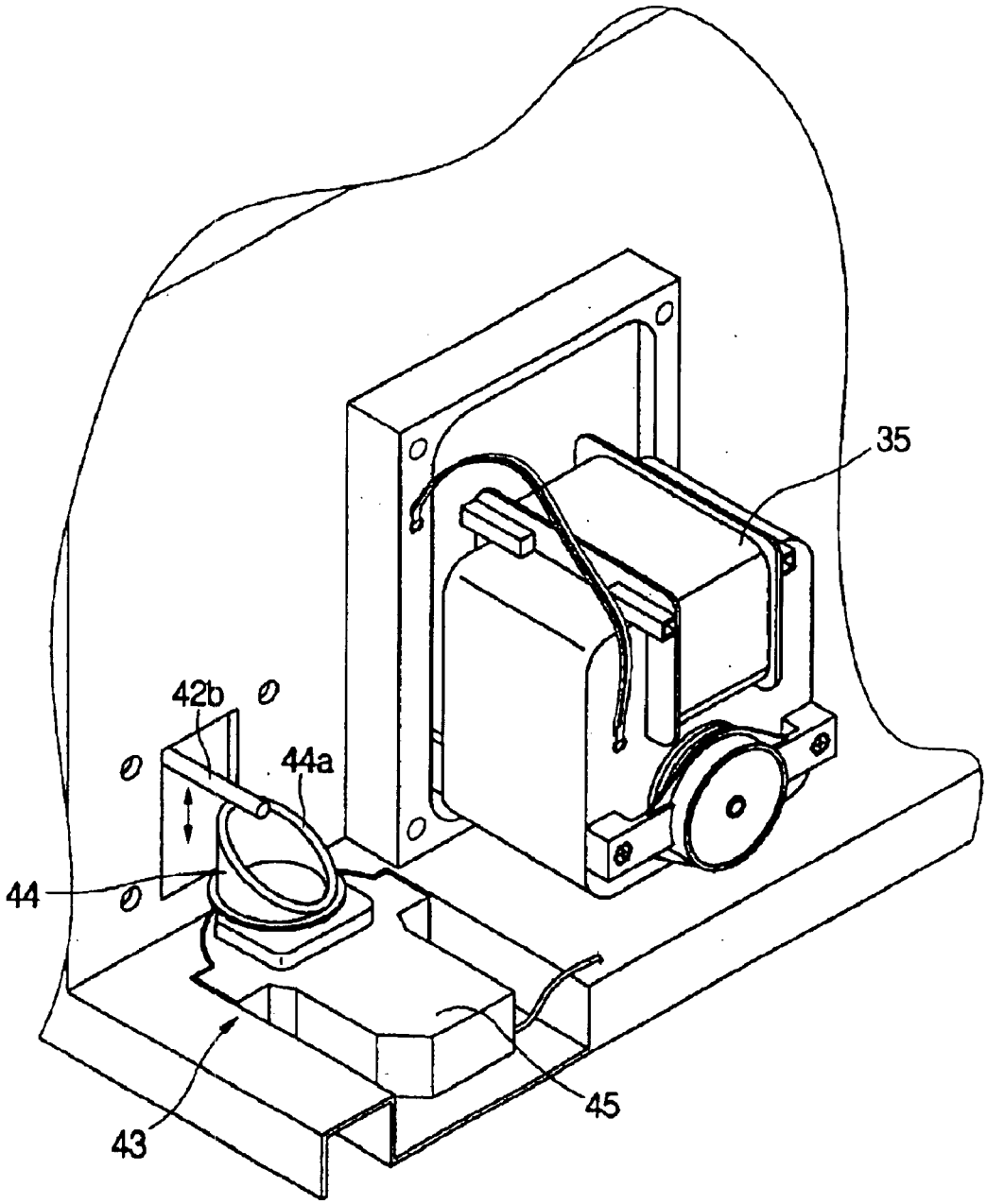
FIG. 5 is a perspective view of a cam drive unit included in the ice feeding unit of FIG. 4.

Referring to FIG. 5, the cam drive unit 43 comprises a rotary cam 44, and a motor 45 to rotate the rotary cam 44. The rotary cam 44 has a cylindrical shape and has an inclined cam face 44*a* at an end thereof. The inclined cam face 44*a* is in contact with the second eccentric part 42*b* of the connection rod 42. When the rotary cam 44 is rotated by the motor 45, the second eccentric part 42*b* of the connection rod 42 which contacts the inclined cam face 44*a* of the rotary cam 44, is rotated while moving upward and downward along the inclined cam face 44*a*. Therefore, the connection rod 42 is smoothly operated without generating noise compared to the conventional solenoid drive unit.

The operation of the ice feeding unit included in the refrigerator constructed as described above will be described in the following.

When a user desires to obtain the ice cubes of a large size, the user manipulates the refrigerator so that the ice cubes of large sizes are selected, and thereafter the switch 21 provided in the ice dispensing recess 20 of the door 12 is manipulated. Then the drive motor 35 of the ice feeding unit 30 rotates the feeding shaft 31 and the spiral blade 32 which are provided in the ice container 16. By the operation, the ice cubes are discharged to the outlet 36 of the ice container 16. Since the outlet 36 of the ice container 16 which is controlled by the control member 41, is completely opened by the cam drive unit 43, the ice cubes are discharged to an outside of the ice container 16 while not being crushed. Since the outlet 36 is completely opened, the ice cubes are discharged through the outlet 36 while not being held between the rotatable cutter 34*b* and the fixed cutter 34*a*. Thus, the ice cubes are discharged to the ice discharging path 19 of the door 12 without being crushed.

However, when the user desires to obtain the ice pieces of a small size, the user manipulates the refrigerator so that the ice pieces are selected, and thereafter the switch 21 provided in the ice dispensing recess 20 of the door 12 is manipulated. The drive motor 35 operates and discharges the ice cubes from the ice container 16. Simultaneously, a portion of the outlet 36 of the ice container 16 is closed by the outlet control unit 40. Thus, the rotary cam 44 is operated by the motor 45 to rotate the connection rod 42. Further, the connection rod 42 rotates the control member 41 to close a part of the outlet 36. Then the ice cubes placed at the outlet 36 are guided to the fixed cutter 34*a* by the control member 41 which closes a portion of the outlet 36. Then the ice cubes are held between the fixed and rotatable cutters 34*a* and 34*b* to be crushed. The crushed ice pieces are discharged to the ice discharging path 19 of the door 12 through an open portion of the outlet 36. When such an operation is executed, the rotary cam 44 of the cam drive unit 43 is rotated while slowly moving the second eccentric part 42*b* of the connection rod 42 up and down. Thus, during operation of opening or closing the outlet 36, noise is not generated.

The present invention provides a refrigerator with an ice feeding unit which is designed such that a drive unit of an outlet control unit which opens or closes an outlet of an ice container comprises a cam drive unit having a rotary cam, thus allowing the outlet of the ice container to be quietly opened or closed.

Although an embodiment of the present invention has been shown and described, it would be appreciated by those skilled in the art that changes may be made in these embodiments without departing from the principles and spirit of the invention, the scope of which is defined in the claims and their equivalents.

What is claimed is:

1. A refrigerator, comprising:

an ice feeding unit comprising:

an ice container which holds ice cubes;

a control member installed at a position around an outlet of the ice container to open and close the outlet of the ice container;

a connection rod rotatably installed at a predetermined position of the ice container to operate the control member, wherein the connection rod comprising:

a first eccentric part provided at a first end of the connection rod which is in contact with the control member, to be eccentric from a center of rotation of the connection rod, and a second eccentric part provided at a second end of the connection rod which is opposite to the first end of the connection rod, to be eccentric from the center of rotation of the connection rod;

a rotary cam installed to be in contact with the second eccentric part of the connection rod, and to rotate the second eccentric part of the connection rod at a predetermined angle; and a motor to drive the rotary cam.

2. The refrigerator of claim 1, wherein the connection rod horizontally extends from a position around the outlet of the ice container to a position opposite to the outlet of the ice container, the connection rod is bent at the first and second ends thereof to form the first and second eccentric parts.

3. The refrigerator of claim 1, wherein the rotary cam is a cylindrical shape having an inclined cam face formed at an end of the rotary cam to be in contact with the second eccentric part of the connection rod.

4. The refrigerator of claim 1, wherein the ice feeding unit further comprising:

a coiled feeding shaft rotatably installed in the ice container;

a spiral blade; and an ice crusher installed at a position around the outlet of the ice container to crush the ice cubes.

5. The refrigerator of claim 1, further comprising:

an ice discharging path provided at a predetermined position of a door to communicate with an interior of a cooling compartment of the refrigerator, wherein the ice feeding unit feeds the ice cubes from the ice container to the ice discharging path; and an ice dispensing recess provided on a front surface of the door to receive the ice cubes discharged through the ice discharging path.

6. The refrigerator of claim 5, wherein the ice dispensing recess comprising:

a switch to open and close an outlet of the ice discharging path and to operate the ice feeding unit; and a guide member to prevent dispersion of the ice cubes discharged from the ice discharging path.

7. The refrigerator of claim 4, further comprising a drive motor mounted to a rear portion of the ice container to rotate the feeding shaft, the spiral blade and the ice crusher.

8. The refrigerator of claim 4, wherein the feeding shaft, the spiral blade and the ice crusher are coaxially arranged in a row.

9. The refrigerator of claim 4, wherein the ice feeding unit further comprising a guide cylinder which surrounds an outer circumference of the spiral blade to push the ice cubes to the outlet of the ice container.

10. The refrigerator of claim 4, wherein the ice crusher comprising:

a fixed cutter which is fixed at a position around the outlet; and a rotatable cutter which is rotated along with the feeding shaft, wherein the ice cubes are held between the fixed and rotatable cutter to be cut.

* * * * *

UNITED STATES PATENT AND TRADEMARK OFFICE

CERTIFICATE OF CORRECTION

PATENT NO. : 6,880,355 B2
DATED : April 19, 2005
INVENTOR(S) : Sang Gyu Jung

It is certified that error appears in the above-identified patent and that said Letters Patent is hereby corrected as shown below:

Title page,
Item [75], Inventor, change “Kwangju” to -- Kwangju-si --.
Item [73], Assignee, change “Suwon” to -- Suwon-si --.

Signed and Sealed this

Third Day of January, 2006

JON W. DUDAS
*Director of the United States Patent and Trademark Office*